US005430601A

United States Patent [19]

Burcham

[11] Patent Number: 5,430,601

[45] Date of Patent: Jul. 4, 1995

[54] ELECTRONIC FUEL INJECTOR DRIVER CIRCUIT

[75] Inventor: Stephen W. Burcham, Madison, Ala.

[73] Assignee: Chrysler Corporation, Highland Park, Mich.

[21] Appl. No.: 56,145

[22] Filed: Apr. 30, 1993

[51] Int. Cl.[6] ..... H01H 47/22

[52] U.S. Cl. ..... 361/154; 361/153; 123/490

[58] Field of Search ..... 361/143, 152, 153, 154, 361/160, 170, 187, 189, 206, 247, 253, 190; 123/490

[56] References Cited

U.S. PATENT DOCUMENTS

| | | | |
|---|---|---|---|
| 4,180,026 | 12/1979 | Schulzke et al. | 361/154 |
| 4,205,648 | 6/1980 | Graham | 123/139 E |
| 4,266,261 | 5/1981 | Streit et al. | 361/154 |
| 4,360,855 | 11/1982 | Ohba | 361/154 |
| 4,631,628 | 12/1986 | Kissel | 361/154 |
| 4,674,460 | 6/1987 | Asmus | 123/470 |
| 4,764,840 | 8/1988 | Petrie et al. | 361/154 |
| 5,159,522 | 10/1992 | Gray | 361/154 |

OTHER PUBLICATIONS

Automotive Electronics, "Fundamental of Electronic Fuel Injection", J. Gyorki, Feb. 1974, pp. 237-244.

"The Electronic Control Unit for Production Electronic Fuel Injection Systems", J. G. Rivard, no date.

*Primary Examiner*—Jeffrey A. Gaffin

*Attorney, Agent, or Firm*—Mark P. Calcaterra

[57] ABSTRACT

An electronic fuel injector driver circuit is a high speed operator of electromagnetic fuel injector valves for internal combustion engine. The drive circuit includes a solenoid coil for each electromagnetic fuel injector. A one shot timer circuit sends a predetermined timing signal to a first controller circuit interconnecting the one shot timer circuit and the solenoid coil wherein the predetermined timing signal is used to control the high side of the solenoid coil. A second controller circuit is connected to the solenoid coil and controls the low side of the solenoid coil in response to the predetermined timing signal. A switchable voltage reference circuit is connected to the second controller circuit and controls current through the solenoid coil.

4 Claims, 2 Drawing Sheets

ELECTRONIC FUEL INJECTOR DRIVER CIRCUIT

BACKGROUND OF THE INVENTION

1. Field of the Invention

The present invention relates generally to electronic fuel injector systems for internal combustion engines, and more particularly, to an electronic fuel injector driver circuit for controlling electromagnetic fuel injector valves for use on internal combustion engines.

2. Description of the Related Art

With the recent interest placed on efficient use of space in automotive vehicles, automotive vehicle manufacturers have asked designers to give-up more engine compartment space for interior passenger compartment space. This is known as "cab forward" design and is quickly becoming commonplace in the automotive industry today. The cab forward design puts a premium on space in the engine compartment, while the customer puts a premium on performance and power. Styling has also played a role in the decay of engine compartment space. Lower hood lines with non-existent front grills are very common. All of these factors have led to the recent renewed interest of applying two-stroke internal combustion engine technology to the automotive vehicle.

One major hurdle in applying two-stroke internal combustion engine technology to the automotive vehicle is the air/fuel delivery into combustion chambers of the engine. The conventional two-stroke internal combustion engine has a crankcase which receives the air/fuel/oil mixture that is then transferred to the combustion chamber during the "power" stroke. This fuel delivery scenario is deemed unacceptable in automotive applications where governmental regulations are getting increasingly more stringent. Clearly, a solution must be derived whereby the air/fuel delivery and the crankcase lubrication system are separated in a manner similar to four-stroke internal combustion engine technology. Recently, a new "external-breathing-direct-fuel-injected" two-stroke internal combustion engine has been developed specifically for automotive vehicles. The engine "breathes" or receives fresh air via an external blower and fuel is injected directly into the combustion chambers during the compression portion of the power stroke.

This new fuel delivery system presents challenges in the area of fuel injection and control. New fuel injectors have been developed to meet the physical requirements of injecting pressurized fuel into pressurized cylinders, achieving proper atomization, and the like. However, these fuel injectors, in order to complete their task, must be controlled in a manner which deviates from the typical control systems present today.

In light of present day consumer demand and stringent government regulation, fuel injector system technology must continue to advance forward. Systems which provide improved performance, better fuel economy as well as reduced exhaust emissions must overcome inherent design limitations which constrain fuel injector valve response time. Primary factors affecting fuel injector valve performance are injector solenoid coil current rise and fall times. Typically, fuel injector response time has been improved by rapidly building the injector solenoid coil current until the injector valve begins to open. The fuel injector valve driver circuit then reduces the applied current to a lower 'holding' value to avoid overheating the injector solenoid coil winding. Finally, current is abruptly turned 'off', and injector solenoid coil current is recirculated through the coil giving a fairly slow injector valve 'close' time.

Fuel injector systems for two-stroke internal combustion engines must utilize an improved version of this control method. The fuel injector system must have the capability of being able to actuate and hold open fuel injector valves for between 200 and 2,000 microseconds which is much shorter than the 2,000 to 10,000 microseconds found in four-stroke internal combustion engines. Short actuation times require ultra-fast fuel injector valve response. As a result, there is a need in the art to provide an electronic fuel injector driver circuit which overcomes the inherent electromechanical fuel injector valve delay problem which can clearly be illustrated in the example below.

Typically, a two-stroke internal combustion engine has an operating condition which requires a five hundred (500) microsecond fuel injector valve actuation time (includes open, hold and close time). This requires that the fuel injection driver circuit produce an electrical pulse five hundred (500) microseconds long. This 500 microsecond valve actuation pulse width involves building up the injector solenoid coil to the 'opening' current of approximately 6–9 amps in approximately 150 microseconds or less, sustain the 'opening' current value for approximately 50 microseconds, ramp down to the 'hold' value of 1–2 amps in less than 50 microseconds, sustain at the 'hold' value for 250 microseconds, finally ramping down to zero, closing the injector valve. Fuel injectors developed for two-stroke internal combustion engine applications typically have an inductance of between 2–3 millihenries and a resistance of 1–2 ohms. Choosing a typical value of 2.4 mH and 1.8 ohms, injector valve time lag can be shown using Equation 1:

$$t_r=(L/R)ln[1/(1-(I_{pk}*R)/V_{BAT})] \qquad \text{Equation 1}$$

$t_r$=opening current rise time
L=fuel injector coil inductance
R=fuel injector coil resistance
$I_{pk}$=peak or 'opening' current
$V_{BAT}$=battery voltage In this example, it can be shown that for such a fuel injector, $t_r$, or the time needed for the injector solenoid coil current to rise to the level needed to open the injector valve, 310 microseconds would have elapsed. Thus, this method is too slow for two-stroke internal combustion engine applications requiring short fuel injector actuation times.

SUMMARY OF THE INVENTION

It is, therefore, one object of the present invention to provide an electronic fuel injector driver circuit for two-stroke internal combustion engine applications.

It is another object of the present invention to provide an electronic fuel injector driver circuit with improved injector solenoid coil current rise time leading to ultra-fast injector valve actuation.

It is yet another object of the present invention to provide an electronic fuel injector driver circuit with quicker injector solenoid coil current decay, leading to shortened injector valve closing time.

It is a further object of the present invention to provide an electronic fuel injector driver circuit which provides two regulated injector solenoid current levels with programmable 'hold' times.

It is a still further object of the present invention to provide an electronic fuel injector driver circuit which provides low power dissipation operation.

To achieve the foregoing objects, the present invention is an electronic fuel injector driver circuit for controlling electromagnetic fuel injector valves for an internal combustion engine including a solenoid coil for at least one electromagnetic fuel injector valve. The circuit also includes a one shot timer means for sending a predetermined timing signal and a means interconnecting the one shot timer means and the solenoid coil for controlling the high side of the solenoid coil in response to the predetermined timing signal. The circuit includes a means connected to the solenoid coil for controlling the low side of the solenoid coil in response to the predetermined timing signal and a switchable voltage reference means connected to the means for controlling the low side of the solenoid coil for controlling current through the solenoid coil.

One advantage of the present invention is that the electronic fuel injector driver circuit decreases injector valve closing time by decreasing injector solenoid coil current fall time. This is accomplished by allowing the fly-back voltage, created at injector valve deactivation, to reach levels 15–20 times the battery potential. Another advantage of the present invention is that the electronic fuel injection driver circuit increases injector valve opening response by decreasing injector solenoid coil current rise time. This is accomplished by applying a potential of eight (8) to ten (10) times the battery potential to the injector solenoid coil. Referring back to Equation 1, it can be shown that boosting the input battery voltage, $V_{BAT}$, by a factor of eight will decrease the injector solenoid coil current rise time from approximately 310 milliseconds to about 159 milliseconds. The boost voltage, $V_{BST}$, is achieved by DC to DC converter techniques.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
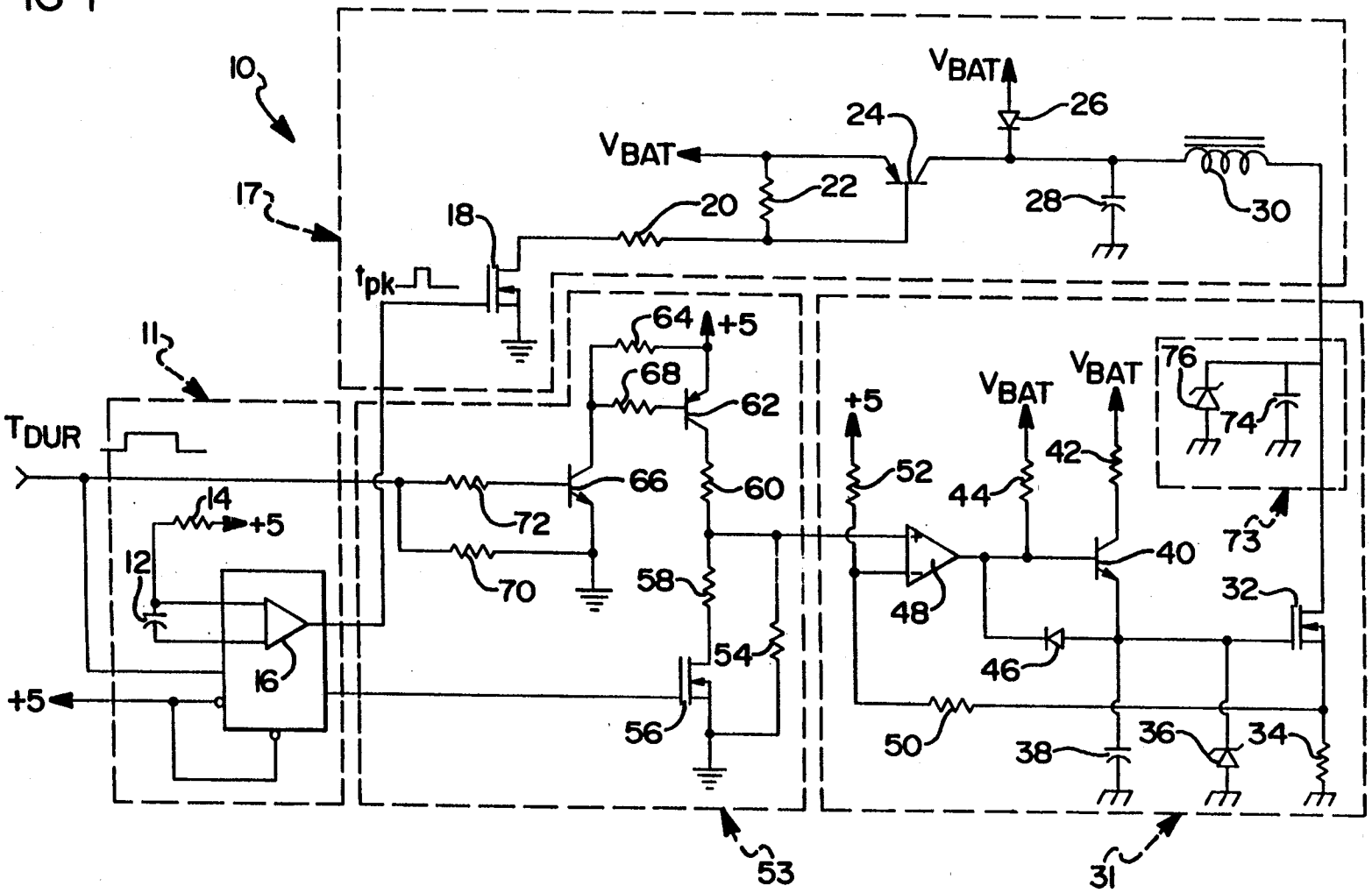
FIG. 1 is a schematic diagram of an electronic fuel injector driver circuit according to the present invention.

Referring to FIG. 1, an electronic fuel injector driver circuit 10, according to the present invention, is illustrated for use on a two-stroke internal combustion engine (not shown). The driver circuit 10, according to the present invention, is suitable for use with multi-point direct fuel injector systems. A discussion of fuel injector control and driver circuits is presented in U.S. Pat. No. 4,631,628 to Kissel and is hereby expressly incorporated by reference.

The driver circuit 10 includes a one shot timer circuit, generally indicated at 11, which sends a timing signal. The one shot timer circuit 11 includes a capacitor 12 which is connected to a resistor 14 and an operational amplifier 16. The resistor 14 is connected to a voltage supply such as five (5) volts. The operational amplifier 16 is also connected to the voltage supply.

The driver circuit 10 also includes a first controller circuit, generally indicated at 17, which controls a high side of a solenoid coil 30 to be described. The first controller circuit 17 includes a transistor 18 whose gate is connected to the operational amplifier 16. The first controller circuit 17 also includes a resistor 20 connected to the drain of the transistor 18 and a resistor 22 connected to the resistor 20 and a boost voltage source, $V_{BST}$, The first controller circuit 17 includes a transistor 24 having its base and emitter connected across the resistor 22. The collector of the transistor 24 is connected to a diode 26 which also is connected to a voltage source, $V_{BAT}$, such as a vehicle battery (not shown). The first controller circuit 17 further includes a capacitor 28 which is connected between the diode 26 and a high side of the solenoid coil 30 and ground. The first controller circuit 17 regulates the amount of current allowed to flow through the solenoid coil 30. It should be appreciated that the solenoid coil 30 is for an electromagnetic fuel injector (not shown) of the fuel injector system (not shown).

The driver circuit 10 also includes a second controller circuit, generally indicated at 31, which controls a low side of the solenoid coil 30. The second controller circuit 31 includes a transistor 32 having its drain connected to the low side of the solenoid coil 30. The second controller circuit 31 also includes a resistor 34 connected between the source of the transistor 32 and ground. The second controller circuit 31 further includes a diode 36 and a capacitor 38 both connected to the gate of the transistor 32 and ground. The second controller circuit 31 includes a transistor 40 whose emitter is connected to the gate of the transistor 32. The second controller circuit 31 also includes a resistor 42 connected between the voltage source $V_{BAT}$ and the collector of the transistor 40 and a resistor 44 connected between the voltage source $V_{BAT}$ and the base of the transistor 40. The second controller circuit 31 further includes a diode 46 connected between the emitter and base of the transistor 40 and an operational amplifier 48 whose output is connected to the base of the transistor 40. The second controller circuit 31 includes a resistor 50 connected to the source of the transistor 32 and a negative input of the operational amplifier 48 and a resistor 52 connected between a voltage source such as five (5) volts and the negative input of the operational amplifier 48. The second controller circuit 31 regulates the amount of current allowed to build through the solenoid coil 30.

The driver circuit 10 also includes a switchable voltage reference circuit, generally indicated at 53, which further includes a dual level switchable voltage reference with an absolute off state. The switchable voltage reference circuit 53 includes a resistor 54 connected to the positive input of the operational amplifier 48 and the source of a transistor 56. The switchable voltage reference circuit 53 also includes a resistor 58 connected between the positive input of the operational amplifier 48 and the drain of the transistor 56. The gate of the transistor 56 is also connected to the operational amplifier 16. The switchable voltage reference circuit 53 includes a resistor 60 connected between the positive input of the operational amplifier 48 and the collector of a transistor 62. The switchable voltage reference circuit 53 includes a resistor 64 connected to the emitter of the transistor 62 and the collector of a transistor 66. The switchable voltage reference circuit 53 includes a resistor 68 connected to the base of the transistor 62 and the collector of the transistor 66. The switchable voltage reference circuit 53 includes a resistor 70 connected between the collector of the transistor 66 and the operational amplifier 16. The switchable voltage reference circuit 53 includes a resistor 72 connected between the base of the transistor 66 and the operational amplifier 16. The switchable voltage reference circuit 53 controls the voltage follower current sink.

The driver circuit 10 also includes a flyback voltage control circuit, generally indicated at 73, which limits the amount of potential to the solenoid coil 30 during coil de-activation. The flyback voltage control circuit 73 includes a capacitor 74 connected between the low side of the solenoid coil 30 and ground. The flyback voltage control circuit 73 further includes a diode 76 connected between the low side of the solenoid coil 30 and ground.

In operation, prior to the firing of the injector valve, battery potential, $V_{BAT}$, is available at the cathode of the diode 26 and the boost voltage, $V_{BST}$, is eight (8) to ten (10) times the battery potential, $V_{BAT}$, is available at the emitter of the transistor 24 The transistors 32 and 24 are turned 'off' allowing no current to flow through the solenoid coil 30. When an injector energization signal, $T_{DUR}$, is received at an input terminal of the driver circuit 10, the transistors 32 and 24 turn 'on' allowing maximum current, $I_{pk}$, to flow from the high boost voltage potential, $V_{BST}$l, through the solenoid coil 30. This causes the fuel injector valve to begin opening. The transistor 24 remains 'on' for a programmable time period, $t_{pk}$, which corresponds to the time required to guarantee full valve opening over all engine operating conditions.

Time period, $t_{pk}$, is a sub-interval of $T_{DUR}$ and is created by the programmable one shot timer circuit 11. Of course, if engine applications require that $t_{pk}$ be 'adaptive' over many operating conditions, a software programmable timer (not shown) can replace the programmable one-shot timer circuit 11.

Once time interval, $t_{pk}$, has elapsed and the injector valve is open, the transistor 24 is turned off, allowing the diode 26 to begin conducting, which supplies the necessary amount of 'hold' current to the solenoid coil 30 and keeps the injector valve in the open position. It should be appreciated that the resistors 20, 22, and the transistor 18 provide a means of switching the base of the transistor 24.

Figure 2:
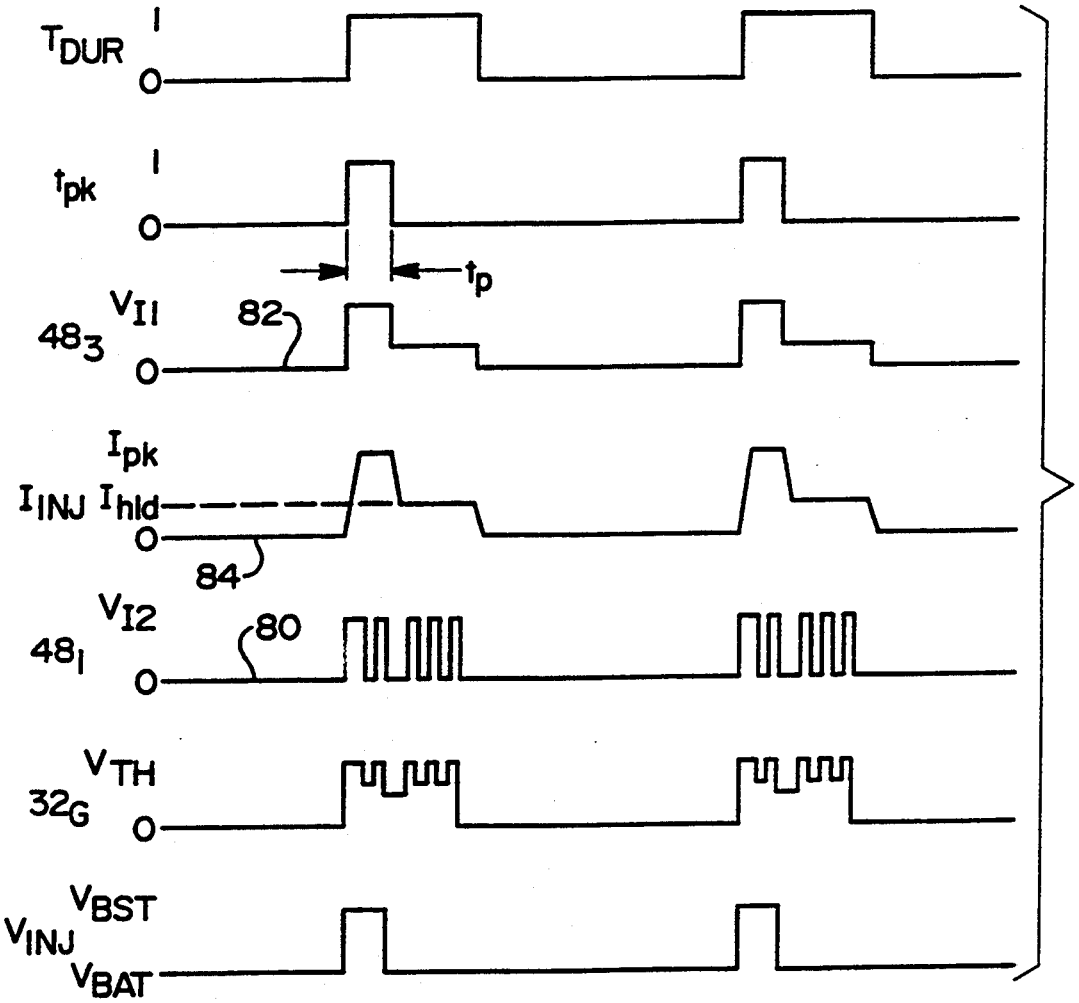
FIG. 2 is a timing diagram depicting the operation of the electronic fuel injector driver circuit of FIG. 1.

Referring once again to FIG. 1, the resistors 72, 70, 64, 68, 60, 54, 58 and the transistors 66, 56, and 62 provide a dual level switchable voltage reference with an absolute 'off' state. The dual reference voltage levels are shown in FIG. 2, waveforms 80 and 82, referring to pins 1 and 3 of comparator 48 i.e., the outputs of first and third pins of comparator 48 are designated as $48_1$, and $48_3$, respectively, as $V_{I1}$ and $V_{I2}$. This dual reference voltage signal controls the 'voltage follower' current sink circuit consisting of the comparator 48, transistors 32 and 40, resistors 34, 42, 44 and diodes 36 and 46. The current sink circuit controls the 'low side' of the solenoid coil 30. When the injector control input signal, $T_{DUR}$ is received, the current sink circuit allows the current to build through the fuel injector by closing the transistor 32. The input signal $T_{DUR}$ controls the duration of injector valve actuation, while $t_{pk}$, a subinterval of $T_{DUR}$, controls how long the peak current, $I_{pk}$, and the boost voltage, $V_{BST}$, is applied to the solenoid coil 30. When the current reaches the peak value, $I_{pk}$, as detected by the resistor 34, the output 48, of the comparator 48 begins to oscillate between the 'on' and 'off' states, allowing the voltage at the gate $32_g$ of the transistor 32, held high by the capacitor 38, to oscillate about its turn-on threshold voltage level $V_{th}$ as represented by line $32_g$ in FIG. 2. This action regulates the injector current at the peak level and continues until time interval, $t_p$, has elapsed.

When $t_p$ has elapsed, $t_{pk}$ goes low, disconnecting the boost voltage, $V_{BST}$, from the 'high side' of the solenoid coil 30 by turning the transistor 24 off and turning transistor 56 'on' forcing the current sink to momentarily turn the transistor 32 'off'. A very high fly-back voltage, limited by the diode 76, appears at the 'low' side of the solenoid coil 30, allowing current $I_{inj}$ to decay rapidly from $I_{pk}$ to the valve holding current $I_{hld}$as is represented by line 84 in FIG. 2. This fly-back voltage provides for an extremely short current fall time by the waveform 84 illustrated in FIG. 2. Once the current sink circuit senses the current as being at or slightly below the 'hold' current level, $I_{hld}$, the comparator 48 begins switching to regulate the current at the injector valve to the 'hold' current level, $I_{hld}$, until control input $T_{DUR}$goes low. At that time, the comparator 48 turns the transistor 32 'off'. Once again, a very short injector current fall time is achieved by allowing the fly-back voltage created at the low side of the solenoid coil 30 to go to a high value with respect to the battery voltage $V_{BAT}$.

This circuit 10 also features low power dissipation operation, achieved by disconnecting boosted voltage $V_{BST}$ with the transistor 24. With the boost voltage $V_{BST}$ disconnected during injector firings, all the hold current is supplied by the battery voltage $V_{BAT}$. This allows for a considerable reduction in power dissipated by the solenoid coil 30. Power dissipation in the transistor 32 can be reduced by removing the capacitor 38, thereby allowing the current to 'switch' rather than regulate at the desired levels. This action reduces the 'on' time or duty cycle of the transistor thereby reducing its power dissipation.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An electronic fuel injector driver circuit for controlling electromagnetic fuel injector valves for an internal combustion engine, comprising:

a solenoid coil for at least one electromagnetic fuel injector valve;

a one shot timer means for sending a predetermined timing signal;

a means interconnecting said one shot timer means and said solenoid coil for controlling a high side of said solenoid coil in response to said predetermined timing signal; and a means connected to said solenoid coil for controlling a low side of said solenoid coil in response to said predetermined timing signal; and a switchable voltage reference means connected to said means for controlling the low side of said solenoid coil for controlling current through said solenoid coil.

2. An electronic fuel injector driver circuit as set forth in claim 1 including means for supplying a predetermined amount of hold current to said solenoid coil.

3. An electronic fuel injector driver circuit for controlling electromagnetic fuel injector valves for an internal combustion engine, comprising:

a solenoid coil for at least one electromagnetic fuel injector valve;

a one shot timer circuit for sending a predetermined timing signal;

a first controller circuit interconnecting said one shot timer circuit and said solenoid coil for controlling a high side of said solenoid coil in response to said predetermined timing signal; and a second controller circuit connected to said solenoid coil for controlling a low side of said solenoid coil in response to said predetermined timing signal; and a switchable voltage reference circuit connected to said second controller circuit for controlling current through said solenoid coil.

4. An electronic fuel injector driver circuit as set forth in claim 3 including a means for supplying a predetermined amount of hold current to said solenoid coil.

* * * * *